US005850239A

United States Patent [19]

Gentile

[11] Patent Number: 5,850,239

[45] Date of Patent: Dec. 15, 1998

[54] MANUAL SELECTING INKJET PRIMER SYSTEM

[75] Inventor: Glenn T. Gentile, San Diego, Calif.

[73] Assignee: Hewlett-Packard Company, Palo Alto, Calif.

[21] Appl. No.: 530,855

[22] Filed: Sep. 20, 1995

[51] Int. Cl.[6] ..... B41J 2/165

[52] U.S. Cl. ..... 347/30; 347/24

[58] Field of Search ..... 347/30, 24, 87; 417/374, 571, 472, 413.1, 412, 44.9; 222/209; 342/30, 24, 29, 22, 23

[56] References Cited

U.S. PATENT DOCUMENTS

| | | | |
|---|---|---|---|
| 1,715,429 | 11/1926 | Saugman | 222/209 |
| 4,577,203 | 3/1986 | Kawamura . | |
| 4,586,058 | 4/1986 | Yamazaki et al. . | |
| 4,931,605 | 6/1990 | Zoller | 200/408 |
| 5,420,619 | 5/1995 | Glassett et al. . | |
| 5,592,201 | 1/1997 | Lim | 347/30 |
| 5,596,354 | 1/1997 | Murphy | 347/30 |

FOREIGN PATENT DOCUMENTS

| | | | |
|---|---|---|---|
| 0 679 516 A2 | 11/1995 | European Pat. Off. . | |
| 359078858 | 5/1984 | Japan | 347/24 |

*Primary Examiner*—Benjamin R. Fuller
*Assistant Examiner*—Thien Tran

[57] ABSTRACT

An inkjet printer priming system having a variable volume chamber in a closed fluid system for each print head, the volume of said variable volume chamber being varied by manual actuation of a button-like surface identified as priming a particular print head, said actuatable surface being coupled to a movable wall incorporated in said variable volume chamber, said movable wall being biased to a position maximizing the volume of said variable volume chamber and said priming system providing tactile and audio feedback to an operator actuating said surface indicating proper priming functions.

20 Claims, 4 Drawing Sheets

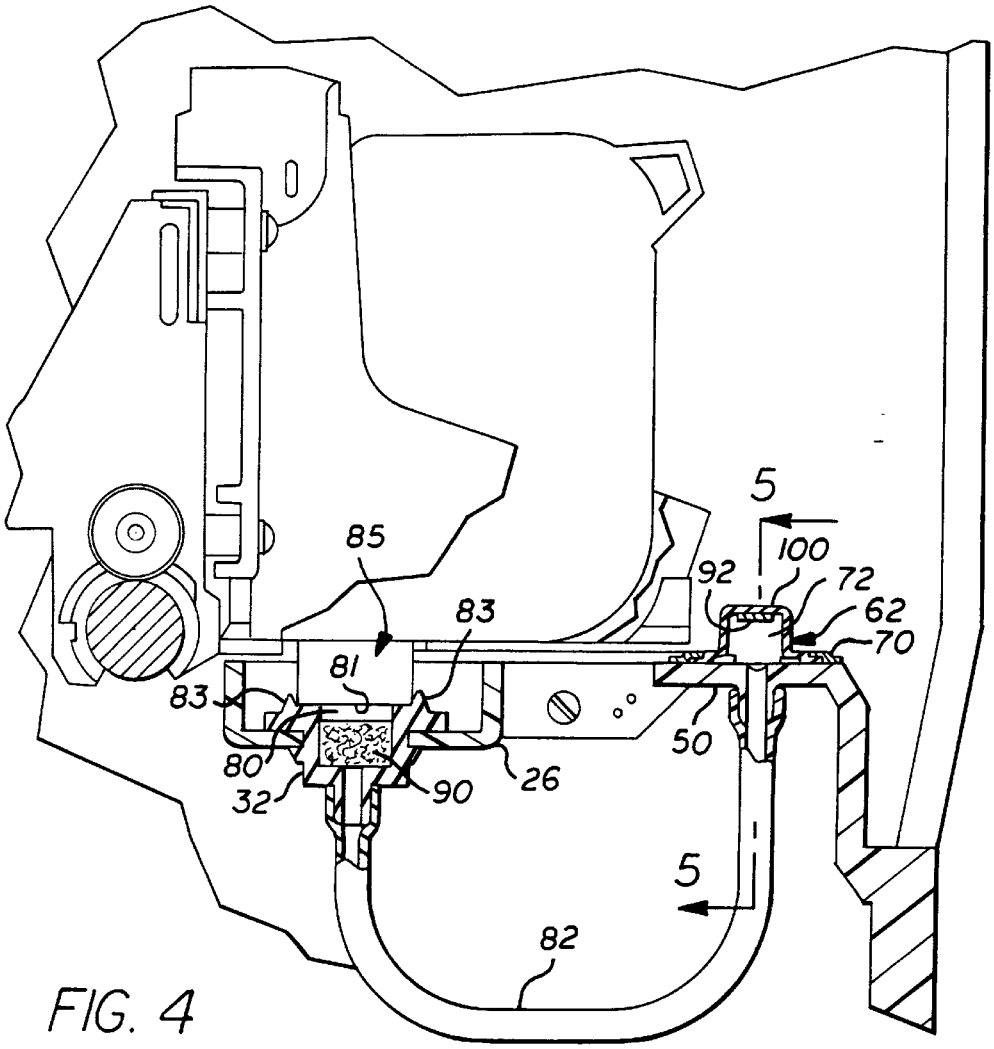
FIG. 4
FIG. 5
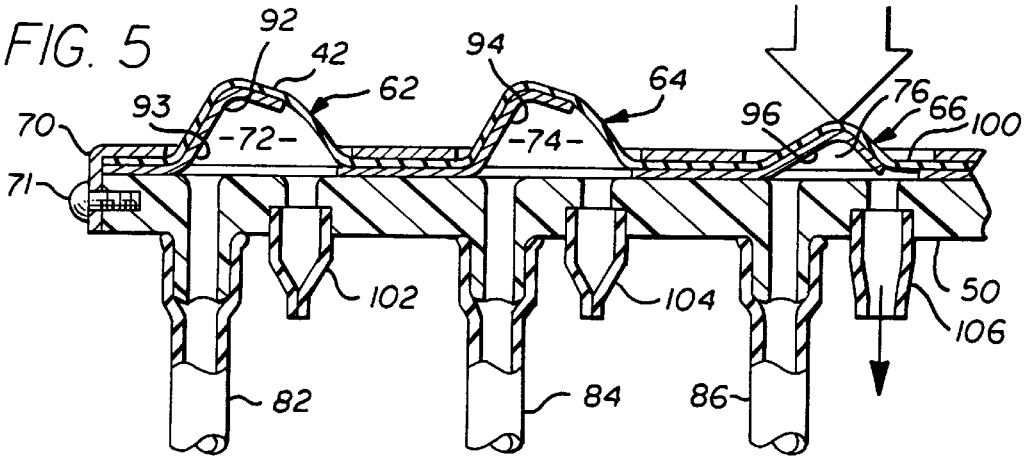

MANUAL SELECTING INKJET PRIMER SYSTEM

RELATED APPLICATIONS

None.

BACKGROUND OF THE INVENTION

1. Field of the Invention

The present invention relates to primer systems for ink cartridges in computer driven inkjet printers. More particularly, the invention relates to primer systems in printers having a "station" whereto an inkjet print head is moved by the carriage, and a "cap" which there sealingly contacts the print head in such a way as to form a "service chamber" immediately adjacent the print head, into which ink is drawn from the print head by application of a subatmospheric pressure within this service chamber.

2. Description of the Related Art

The function of such a primer system is to draw ink through the print head of a thermal inkjet print cartridge to clear the print head when it has become inoperable, for example being in some way clogged by dried ink or other obstruction, or obstructed by an air bubble, preventing proper print head operation. A consideration in the design of such primers is making the print head operational with a minimum amount of wasted ink. One current approach is to provide a bellows connected, by a closed conduit, to a service station having a flexible cap or cuff to which the print head is moved by the carriage. The cap sealingly engages the print head face when it is brought into contact therewith, and forms a service chamber adjacent the print head face creating a closed fluid system comprising the interior of the bellows, the conduit, and service station service chamber adjacent the print cartridge. Also incorporated in the service station is a filter disposed in the fluid system between the conduit and the service chamber which prevents ink from being drawn into the conduit.

In a cycle of priming system operation, the bellows is compressed, and in doing so air is allowed to escape from the system. The bellows is then subsequently expanded drawing ink from the print head and in so doing, optimally clearing, for example, crusted ink both internal and external to the print head nozzle plate, or purging trapped air bubbles from within the print head.

Ink thus drawn from the print head collects on the print head nozzle plate in the service chamber and is subsequently removed by action of a wiper as the carriage moves from the station. Any ink pulled free of the print head nozzle plate is trapped in the filter adjacent the service chamber at the station.

In an inkjet printer employing multiple print heads, for example, each using a color ink (e.g. cyan, magenta, or yellow), or a black ink, kept in a separate cartridge ink reservoir associated with an individual print head, a selector arrangement is provided to sealingly couple and uncouple the bellows as required to individual conduits leading to individual service stations for each print head, allowing an operator to select the print head to be primed. Such an arrangement implicates complexity, and commensurate parts and assembly costs. And, furthermore, an operator operating a selector level may accidentally mis-select the print head to be primed.

Further details concerning such an arrangement can be found in U.S. Pat. No. 5,420,619 issued May 30, 1995 to Glassett, et al. and assigned to the assignee of the present invention.

The known priming apparatus just described, as well as other known priming systems, having relatively numerous parts raise the overall cost of an inkjet printer employing such primer systems. Ink is sometimes wasted due to misselection of the proper print head to be primed. Moreover, if the print head is not restored to proper functions by a less than fully effective priming cycle, the operator will not know until printing commences again. The print head must subsequently be primed a second (or third, etc.) time, giving rise to wasted time, ink and/or paper and user frustration. Those concerned with the art have recognized a need for providing intuitive and effective primer function at a lower cost. It is to these ends that the invention is directed.

SUMMARY OF THE INVENTION

The present invention accordingly provides a print head priming system in a computer-driven inkjet printer having a print head carried by a movable carriage and a priming station to which said print head can be moved by said carriage. Said priming station having a flexible seal cuff sealingly engaging a said print head when said print head is positioned at the priming station, a service chamber is created adjacent the print head and seals said print head from the atmosphere and creates a closed fluid system allowing a subatmospheric pressure to be applied to the print head for priming. The priming system comprising an enclosure forming a variable volume chamber having a movable wall manually directly actuatable to change the volume in said chamber, said chamber being fluidly connected to said service chamber of said priming station, said movable wall having a first position defining a maximum interior volume of said variable volume chamber and a second position defining an interior volume of said variable volume chamber less than that defined by said movable wall at its first position. Said moveable wall is biased toward the first position maximizing the interior volume of said variable volume chamber, and creates a subatmospheric pressure within said variable volume chamber and within said service chamber adjacent said print head when moving from the second position to the first position. A check valve in fluid communication with said variable volume chamber allowing fluid to pass therethrough when the movable wall is actuated so as to reduce the volume of said chamber and pressurize the system to a point above atmospheric. The check valve prevents fluid from passing therethrough when the movable wall moves so as to reduce the volume within said chamber, and when the pressure within said chamber is below atmospheric.

In a more detailed aspect, the primer system can be applied to inkjet printers having multiple print heads and one actuatable surface can be provided for each print head. A print head identifier may be associated with each actuatable surface, for example a color coded symbol, or simply by placing each actuatable surface directly adjacent the print head primer service station whereat the individual print head is located when the print heads are moved to the stationary priming position by the carriage thereby using ink color identification on the carriage or on the ink cartridges themselves.

In a further more detailed aspect the actuatable surface can be spring loaded in such a way that there is a tactile feedback when the actuatable surface is sufficiently deflected to properly prime the associated print head on rebound of the actuatable surface. A audible feedback can also be provided, for example a "click" which is heard as well as felt.

Moreover, in another detailed aspect, the movable actuatable surface can form a membranous envelope in the shape of a button to be actuated by the operator. A "snap spring" can be provided beneath the flexible wall to give its outer actuatable surface the appropriate shape, and to provide the biasing action creating the vacuum when the surface is released after being compressed by an operator. Furthermore, the characteristics of the spring, and consequently of the priming system, can be individualized for each print head. This allows for optimal priming of print heads having different opening areas (i.e. resolution) or employing inks of differing viscosities for example. Such a system, where the operator directly selects the priming function and directly actuates the flexible surface which is involved in providing the vacuum for the priming function, increases the user's awareness of the primer function. Such a system is easy to use, and is intuitive due to the provision of color coding and/or the positioning of the actuatable surface adjacent the station at which the associated print head will be primed.

As will be apparent from the detailed description given below, primer function at least as good as known systems is provided, at a lower cost, in the primer system of the present invention. Compared to certain known priming systems improved performance is obtained, and this results in higher user satisfaction and a reduction in the amount of wasted ink etc. as the number of priming cycles required to clear a print head is reduced.

BRIEF DESCRIPTION OF THE DRAWINGS

FIG. 4 is a cross-section, partially in elevation view, of the system of FIG. 3 taken along line 4—4 therein;

FIG. 5 is a cross-section of the primer system of FIG. 4 taking along 5—5 therein, illustrating aspects of the operation thereof;

DESCRIPTION OF THE PREFERRED EMBODIMENTS

Figure 1:
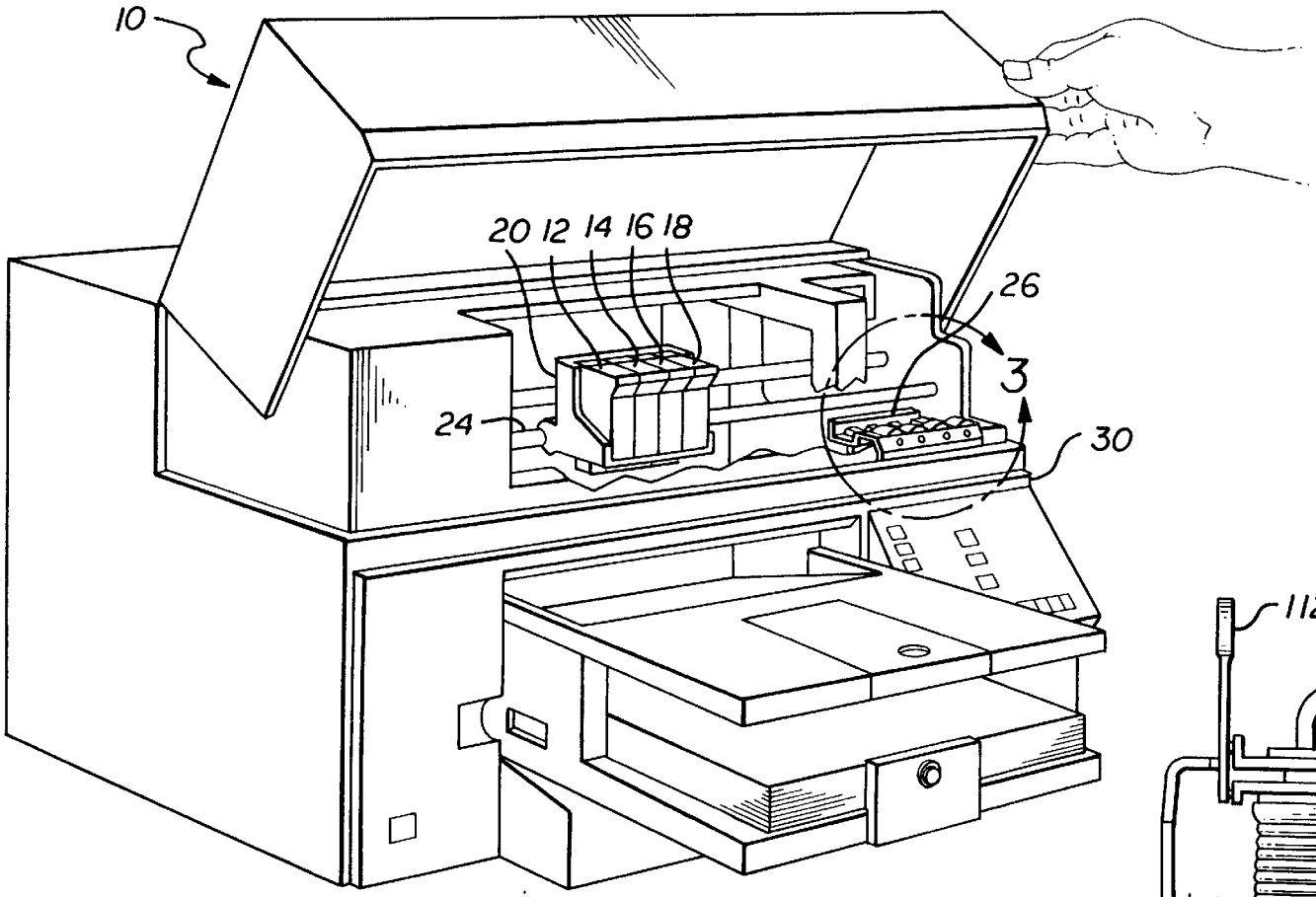
FIG. 1 is a perspective view of a computer driven printer, illustrating the environment of the invention.

With reference to FIG. 1 of the drawings, which are given by way of example and not by way of limitation, a computer driven printer 10 employs multiple print head ink cartridges 12, 14, 16, 18 mounted on a carriage 20 slidably supported by carriage support member 24. A print head service station tray 26 is movably mounted on a printer chassis 30 along a path of motion of the carriage. The service station tray is positioned so that the ink cartridges can be moved thereto for priming, storage, or other service.

Figure 3:
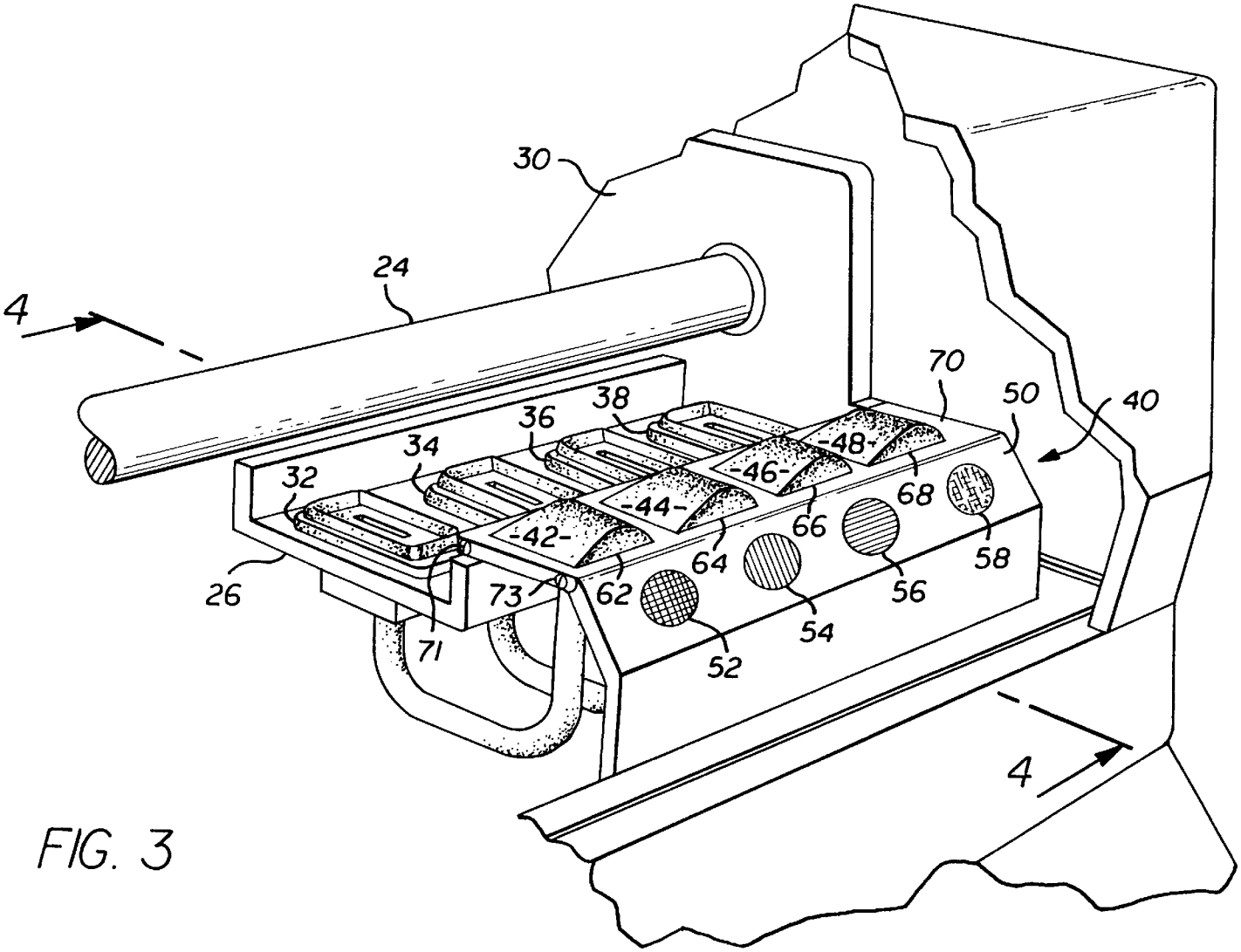
FIG. 3 is an enlarged perspective view of the area indicated by the numeral 3 in FIG. 1, illustrating the primer system of the invention.

Referring now to FIGS. 1 and 3, the service station tray 26 includes a plurality of elastomeric priming station caps 32, 34, 36 and 38 employed by the priming system of the present invention. The printer chassis 30 supports the rest of the priming system 40 including four button-like actuatable surfaces 42, 44, 46, and 48 mounted on a substrate portion 50 of the chassis 30. These button-like actuatable surfaces are positioned such that each individual actuatable surface is aligned with the priming station with which it is associated through a fluid connection. Four identifiers 52, 54, 56 and 58, are located on the substrate 50, one adjacent each button-like actuatable surface. Each identifier comprises a color-coded symbol having a color indicative of the color of the print head ink cartridge which is serviced by the associated priming station of the button-like actuatable surfaces with which each individual identifier is placed in close proximity and/or aligned. Alternatively to, or in conjunction with, use of color coded identifiers, each button-like actuatable surface is simply aligned with the position of the ink cartridge it is to service when the carriage is at the service station tray 26 as mentioned. In this later case identification (not shown) on the respective ink cartridges 12, 14, 16, and 18 and/or the carriage 12 provides a reference for an operator. The operator, then, can have a visual reference by alignment of the above-mentioned elements, and/or a reference arising by virtue of the color aspect of the respective identifiers, decreasing the likelihood of priming the wrong print head by mistake.

Actuatable surfaces 42, 44, 46 and 48 comprise raised portions of button-like flexible elastomeric membranous envelopes 62, 64, 66, and 68, respectively. A metal retainer 70 affixed to the substrate 50 by fasteners 71 and 73 holds the membranous envelopes sealingly against the substrate 50. The retainer can alternatively be formed of a rigid polymer resin or composite material, or comprise a portion (not shown) of the chassis 30. As will be apparent, the fasteners can be eliminated and other means used to position the respective components of the system, as is known in the art.

Referring now to FIGS. 3 and 4, within a button-like elastomeric envelope 62 a variable volume chamber 72 is formed. Corresponding variable volume chambers (not shown) are formed within button-like envelopes 64, 66 and 68 respectively. The variable volume chamber 72 is connected to the priming station cap 32 by a conduit 82. A service chamber 80 is formed adjacent a print head face plate 81 by the cap 32 having an elastomeric cuff 83 which sealingly engages the print head face plate when a print head 85 is positioned at the service station cap 32.

Referring now to FIGS. 4 and 5, the variable volume chamber 72, conduit 82 and service chamber 80 comprise a closed fluid system when the print head 85 is positioned at the service station cap 32. A filter 90 is positioned in the fluid system adjacent the service chamber to prevent ink not retained on the print head face plate 84 after priming from entering the fluid conduit 82.

In operation, the variable volume chamber 72 is reduced by manual actuation of the surface 42 comprising the central raised portion of the button-like elastomeric envelope 62 against the force of a snap spring 92. A cut-out flange 93 is provided to "catch" as the snap spring is deflected and provide a tactile and audio feed back "snap" or "click" when the snap spring is deflected to a point where sufficient energy is stored in the spring, and the variable volume chamber 72 is small enough, so that proper priming function is obtained on rebound of the snap spring when the button-like actuatable surface 42 is released by the operator. The catching action of the snap spring also tends to delay rebound so that an operators finger (not shown) is not exerting pressure hampering rebound as the finger is drawn away from the button-like actuatable surface. Similar snap springs 94 and 96 are positioned within the additional button-like flexible elastomeric membranous envelopes e.g. 64 and 66 shown. The snap springs 92, 94, and 96 are held between the substrate 50 and the retainer 70 in a sandwich configuration which also includes a single sheet of elastomeric material 100, which, when compressed against the substrate 50 by the retainer 70 over the snap springs 92, 94 and 96, forms the button-like flexible elastomeric membranous envelopes. With deflection of a snap spring (96 in FIG. 5 for example) the elastomeric sheet 100 comprising the button-like envelope 66 contracts as the snap spring 96 is compressed against the substrate 50. Consequently the volume of fluid, in this case air, in the variable volume chamber 76 within the button-like envelope 66 is reduced. Associated with each variable volume chamber is a check valve, which in the illustrated embodiment comprise duckbill valves e.g. 102, 104 and 106 shown. Other types of check valves can be used. With the reduction of volume in variable volume chamber 76 a superatmospheric pressure therein causes the duckbill valve 106 to open and air to be expelled from the variable volume chamber therethrough.

After the snap spring 96 has been depressed to the point where tactile and audio feedback to the operator indicates that it has been deformed sufficiently to provide proper primer function on rebound, the button-like actuatable surface is released and the snap spring immediately exerts an expanding force on the elastomeric sheet 100 defining the button-like envelope 66 forming a variable volume chamber 76. Referring now to variable volume chamber 72, this causes pressure within the variable volume chamber to fall below atmospheric, whereupon the duckbill valve 102 closes and a vacuum builds within the closed fluid system comprising the variable volume chamber, the conduit 82 and the service chamber 80. Ink is drawn from the print head 85 and collects on the print head face plate 81. When the print head is moved from the primer station position the ink is wiped from the print head face plate by a wiper (not shown) provided adjacent the cap 32.

Figure 2:
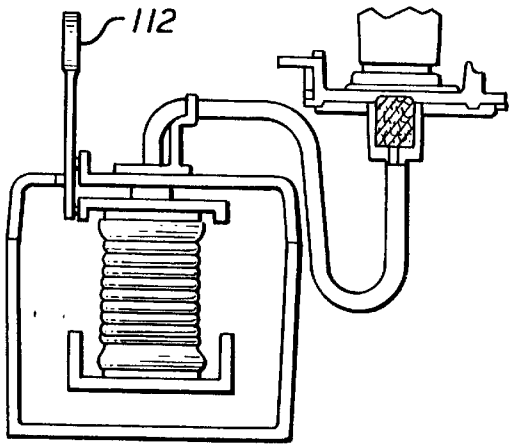
FIG. 2 PRIOR ART
FIG. 2 is a schematic representation of a bellows system of a known primer system incorporating a bellows.
Figure 6:
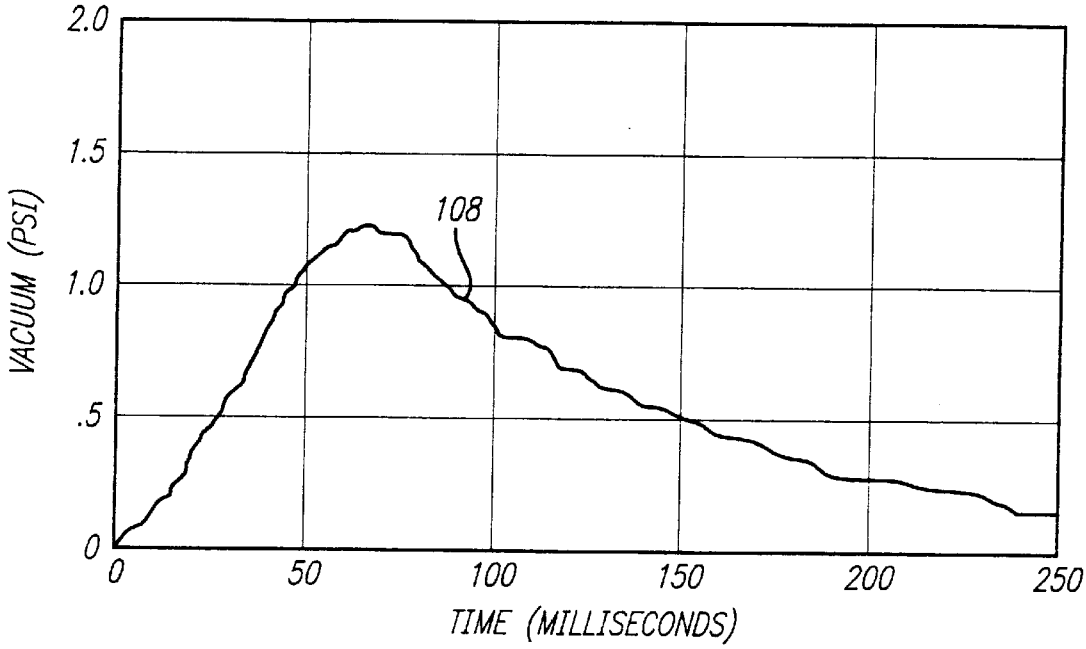
FIG. 6 is a time versus pressure (vacuum)plot illustrating the vacuum applied by the primer system of the invention in operation.
Figure 7:
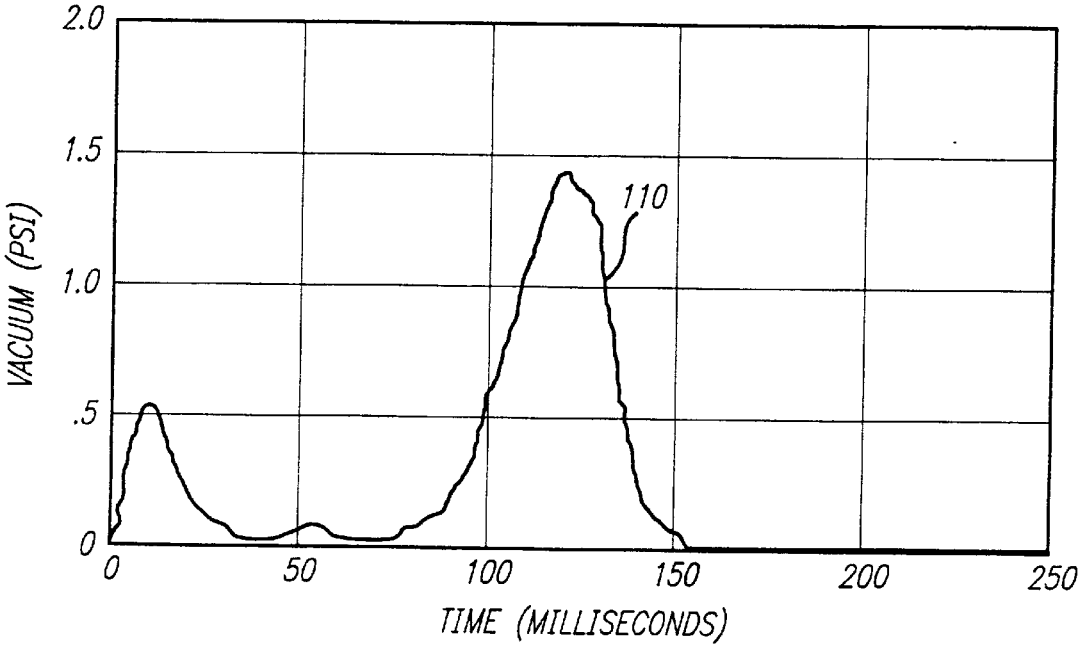
FIG. 7 is a pressure (vacuum) versus time plot of the known bellows system of FIG. 2.

Referring now to FIGS. 6 and 7, vacuum versus time plots for the priming system of the present invention and a known device are illustrated. The vacuum curve plot 108 of FIG. 6 is for a single closed fluid priming system of the invention, and the vacuum curve plot 110 of FIG. 7 is for a bellows device such as that illustrated schematically in FIG. 2 and which requires a relatively complex bellows actuation means (not shown) and manipulation of a selector arm 112 by a user.

As will be appreciated, the priming function of the system of the present invention provides a vacuum cycle of longer duration and more uniform aspect. The vacuum versus time curve for the bellows device evidences a vacuum cycle separated into two uneven spikes separated by a period of normal atmospheric pressure. The area under the respective curves points out the relatively greater effectiveness of the priming system of the invention. This allows improved priming in a first attempt, reducing the need for subsequent priming cycles. Fewer priming cycles required to prime an individual print head results in a savings in time, trouble and ink, giving better performance from the user's perspective, and reducing frustration and waste.

It can be appreciated that the priming system of the present invention provides priming function in a system of simple configuration and commensurately simple parts and assembly requirements. Moreover, the illustrated priming system is intuitive and easy to use, as the position of the button-like actuatable surfaces 62, 64, 66, 68 correspond with the positions of the print head ink cartridges 12, 14, 16, 18 when positioned at the service station tray 26 as mentioned. Finally, the configuration of the invention allows customization of primer function for each ink cartridge, for example by providing a stiffer snap spring for a more viscous ink, and/or more resolution (smaller openings), further improving priming function. These features give rise to overall better performance, and this is achieved at a lower cost.

Persons skilled in the art will readily appreciate that various modifications can be made from the preferred embodiment of the invention disclosed herein and that the scope of protection is intended to be defined only by the limitations of the appended claims.

I claim:

1. A print head priming system in a computer-driven inkjet printer having a print head carried by a movable carriage and a priming station to which said print head is moved by said carriage, said priming station having a flexible seal cuff sealingly engaging said print head when said print head is positioned at the priming station, creating a service chamber adjacent the print head and sealing said print head from a surrounding atmosphere and creating a closed fluid system allowing application of a subatmospheric pressure to the print head for priming, comprising:

an enclosure forming a variable volume chamber having a movable wall manually directly actuatable to change a volume in said chamber, said chamber being fluidly connected to said service chamber of said priming station, said movable wall having a first position defining a maximum interior volume of said variable volume chamber and a second position defining an interior volume of said variable volume chamber less than said maximum interior volume defined by said movable wall at said first position, said moveable wall being biased toward the first position maximizing the interior volume of said variable volume chamber and creating said subatmospheric pressure within said variable volume chamber and within said service chamber adjacent said print head when moving from the second position to the first position;

a spring in force transmitting contact with said movable wall, biasing said movable wall from said second position to said first position;

a catch engaged with said spring which provides a tactile feedback when said spring is deflected due to movement of said movable wall in a direction from said first position toward said second position a distance great enough to load said spring with energy sufficient to provide sufficient vacuum on spring rebound for proper primer operation; and, a check valve in fluid communication with said variable volume chamber allowing fluid to pass out of said chamber therethrough when the movable wall is actuated so as to reduce the volume of said chamber, and when the pressure within said chamber rises above atmospheric, and said check valve preventing fluid from passing therethrough into said chamber when the movable wall moves so as to reduce the volume within said chamber, and when the pressure within said chamber is below atmospheric.

2. The print head priming system of claim 1, wherein said movable wall is flexible.

3. The print head priming system of claim 2, further comprising a spring biasing said movable wall from said second position to said first position, a surface portion of said spring being in contact with and configured to shape said flexible movable wall into a button-like shape having a button-like manually actuatable outer surface.

4. The print head priming system of claim 1, wherein said printer further comprises a plurality of print heads each having an associated priming station, and wherein each such print head and priming station has its own independent print head priming system according to the invention, and each has a manually actuated surface coupled to said movable wall and an identifier adjacent said surface identifying which of the plurality of print heads is primed by actuation of said surface.

5. The print head priming system of claim 4 wherein a first print head differs from a second print head and the independent print head priming system associated with the first print head differs from the independent print head priming system associated with the second print head with respect to at least one of a group of priming characteristics consisting of: a) magnitude of vacuum applied; b) duration of time when vacuum is applied; and c) variation of magnitude of vacuum applied with time.

6. A print head priming system in a computer-driven inkjet printer having a print head carried by a movable carriage and a priming station to which said print head is moved by said carriage, said priming station having a flexible seal cuff sealingly engaging a said print head when said print head is positioned at the priming station, creating a service chamber adjacent the print head and sealing said print head from the atmosphere and creating a closed fluid system allowing application of a subatmospheric pressure to the print head for priming, comprising:

an enclosure forming a variable volume chamber having a flexible movable wall having a first position and a second position and manually directly actuatable to reduce the volume in said chamber by moving from said first position to said second position, said chamber being fluidly connected to said service chamber of said priming station;

a spring biasing said movable wall toward a position maximizing the interior volume of said variable volume chamber and configured to create a subatmospheric pressure within said variable volume chamber said service chamber adjacent said print head when acting on said movable wall to move the movable wall from said second position to said first position, wherein said spring is a snap spring providing a tactile feedback when sufficiently deflected due to movement of said movable wall in a direction from said first position toward said second position so that said spring is sufficiently loaded to provide sufficient vacuum on rebound for proper primer operation; and a check valve in fluid communication with said variable volume chamber allowing fluid to pass therethrough when the movable wall is actuated so as to reduce the volume of said chamber, and when the pressure within said chamber rises above atmospheric, and preventing fluid from passing therethrough when the movable wall moves so as to reduce the volume within said chamber, and when the pressure within said chamber is below atmospheric.

7. The print head priming system of claim 6, wherein said flexible movable wall defines a raised central portion at said first position, forming an actuatable button-like outer surface.

8. The print head priming system of claim 7, wherein a surface portion of said spring is configured to shape said flexible movable wall into a button-like shape, said movable wall comprising said button-like manually actuatable outer surface of said movable wall.

9. The print head priming system of claim 8, wherein said check valve is a duck-bill valve.

10. The print head priming system of claim 6, wherein said printer further comprises a plurality of print heads each having an associated priming station, and wherein each such print head and priming station has a independent print head priming system, and each has a manually actuated surface coupled to said movable wall and an identifier adjacent said surface identifying which of the plurality of print heads is primed by actuation of said surface.

11. The print head priming system of claim 10, wherein the independent print head priming system associated with each said print head is configured specifically for optimizing primer function for its associated print head.

12. A manual selecting print head priming system in a computer-driven inkjet printer having multiple print heads, each print head being carried by a movable carriage, and multiple priming stations, a priming station associated with each such print head, each said priming station having a flexible seal cuff sealingly engaging an associated print head when said associated print head is positioned at the priming station, each creating a service chamber adjacent the associated print head and sealing said associated print head from ambient atmosphere, each creating a separate closed fluid system allowing application of a subatmospheric pressure to the associated print head for priming, each such closed fluid system further comprising:

a flexible envelope enclosure forming a variable volume chamber having a flexible movable wall having a first position and a second position and manually directly actuatable to reduce a volume in said chamber by moving from said first position to said second position, said chamber being fluidly connected to said service chamber of said priming station;

a spring biasing said movable wall toward a position maximizing the interior volume of said variable volume chamber and configured to create a subatmospheric pressure within said variable volume chamber said service chamber adjacent said print head when acting on said movable wall to move the movable wall from said second position to said first position, wherein said spring is a snap spring providing a tactile feedback when sufficiently deflected due to movement of said movable wall in a direction from said first position toward said second position so that said spring is sufficiently loaded to provide sufficient vacuum on rebound for proper primer operation;

a check valve in fluid communication with said variable volume chamber allowing fluid to pass therethrough when the movable wall is actuated so as to reduce the volume of said chamber, and when the pressure within said chamber rises above atmospheric, and preventing fluid from passing therethrough when the movable wall moves so as to reduce the volume within said chamber, and when the pressure within said chamber is below atmospheric; and an associated print head identifier which identifies the print head primed by manual actuation of the flexible movable wall, whereby manual actuation of a selected flexible movable wall causes priming of a print head identified as associated with a priming station comprising the closed fluid system comprising said flexible movable wall.

13. The print head priming system of claim 12, wherein a surface portion of said spring is configured to shape said flexible movable wall to form said button-like manually actuatable outer surface of said movable wall.

14. The print head priming system of claim 13, further comprising a rigid support substrate, said flexible wall comprising a membranous sheet of flexible air impervious material sealingly attached to the support substrate at all edges of the flexible sheet, so as to form the button-like surface with a raised portion interior to said edges forming said actuatable surface.

15. The print head priming system of claim 12, wherein said actuatable surface is positioned adjacent an associated priming station and the position of said actuatable surface comprises said identifier to identify the print head primed by the priming system.

16. The print head priming system of claim 12, where said identifier for each actuatable surface comprises a color displayed in connection with the surface.

17. A priming system for an ink jet print head comprising:

a priming station for forming an air tight service chamber with the print head to facilitate the priming of the print head by the application of subatomospheric pressure within said chamber;

a substrate having at least two airway passages disposed therein for facilitating the application of subatomspheric pressure to said chamber;

a check valve mounted to said substrate at one of said airway passages and in fluid communication with said chamber via the other one of said airway passages for facilitating the formation of subatomspheric pressure within said chamber when said check valve is moved from an opened position in fluid communication with atmospheric pressure to a closed position blocking fluid communication with atmospheric pressure;

a sheet of elastomeric material mounted to said substrate for sealing one end of said airway passages from the atmosphere to further facilitate the application of subatomospheric pressure to said chamber;

a snap spring sandwiched between said substrate and said sheet of elastomeric material for facilitating the formation of a variable volume chambers in fluid communication with the service chamber and said check valve to facilitate the actuation of said check valve from said closed position to said opened position when said snap spring is deflected by a user toward said substrate and for facilitating the application of subatomspheric pressure to said service chamber when said snap spring rebounds from its deflected position.

a catch for providing an audible sound when said snap spring is sufficiently deflected for priming purposes so that the user can verify that a proper priming function is obtained when the user releases said snap spring from its deflected position.

18. An ink jet print head priming system having a priming station for forming an air tight service chamber with the print head comprising:

a substrate having at least two airway passages disposed therein for facilitating the application of subatomospheric pressure to the service chamber;

a check valve mounted to said substrate at one end of said airway passages and in fluid communication with the service chamber via the other one of said airway passages for facilitating the formation of subatmospheric pressure within the service chamber when said check valve is moved from an opened position in fluid communication with atmospheric pressure to a closed position blocking fluid communication with atmospheric pressure;

a sheet of elastomeric material mounted to said substrate for sealing one end of said airway passages from the atmosphere to further facilitate the application of subatmospheric pressure to the chamber; and a snap spring sandwiched between said substrate and said sheet of elastomeric material for facilitating the formation of a variable volume chamber in fluid communication with the service chamber and said check valve to facilitate the actuation of said check valve from said closed position to said opened position when said snap spring is deflected toward said substrate and for facilitating the application of subatomspheric pressure to said service chamber when said snap spring rebounds from its deflected position.

19. an inkjet priming system according to claim 18, further comprising:

a catch for delaying the rebound of said snap spring when said snap spring is released from its deflected position to provide a proper priming function to the print head.

20. An inkjet priming system according to claim 18, further comprising:

a catch for providing an audible sound when said snap spring is sufficiently deflected for priming purposes so that a user can verify that a proper priming function is obtained when a user releases said snap spring from its deflected position.

* * * * *

UNITED STATES PATENT AND TRADEMARK OFFICE

CERTIFICATE OF CORRECTION

PATENT NO. : 5,850,239

DATED : December 15, 1998

INVENTOR(S) : Glenn T. Gentile

It is certified that error appears in the above-identified patent and that said Letters Patent is hereby corrected as shown below:

At Column 7, line 3, after "system", delete "according to the invention".

At Column 9, line 35, after "volume", delete "chambers" and insert in lieu thereof --chamber--.

At Column 9, line 39, after "substrate", insert "to a deflected position";

At Column 9, line 42, after "rebound, from", delete "its" and insert in lieu thereof --said--.

At Column 10, line 11, after "chamber", delete "via" and insert in lieu thereof --through--;

At Column 10, line 32, delete "an" and insert in lieu thereof "An";

At Column 10, line 35, after "from", delete "its" and insert in lieu thereof --said--;

At Column 10, line 42, after "from", delete "its" and insert in lieu thereof --said--.

Signed and Sealed this

Twenty-sixth Day of September, 2000

*Attest:*

Q. TODD DICKINSON

*Attesting Officer*

*Director of Patents and Trademarks*